US008628088B2

(12) United States Patent
Sakdinan

(10) Patent No.: US 8,628,088 B2
(45) **Date of Patent: *Jan. 14, 2014**

(54) PUZZLE WITH THREE DIMENSIONAL REPRESENTATION OF GEOGRAPHIC AREA

(75) Inventor: Shaun Sunt Sakdinan, Markham (CA)

(73) Assignee: 2307450 Ontario Limited, Markham (CA)

( * ) Notice: Subject to any disclaimer, the term of this patent is extended or adjusted under 35 U.S.C. 154(b) by 22 days.

This patent is subject to a terminal disclaimer.

(21) Appl. No.: 13/379,122

(22) PCT Filed: Jun. 17, 2010

(86) PCT No.: PCT/CA2010/000925

§ 371 (c)(1), (2), (4) Date: Dec. 19, 2011

(87) PCT Pub. No.: WO2010/145023

PCT Pub. Date: Dec. 23, 2010

(65) Prior Publication Data

US 2012/0098193 A1 Apr. 26, 2012

Related U.S. Application Data

(63) Continuation of application No. 12/488,103, filed on Jun. 19, 2009, now Pat. No. 8,074,988.

(51) Int. Cl.
*A63F 9/10* (2006.01)

(52) U.S. Cl.
USPC ..... 273/157 R; 434/150

(58) Field of Classification Search
USPC ..... 273/157 R, 156; 434/154, 149, 150, 434/151, 152, 153; 446/118
See application file for complete search history.

(56) References Cited

U.S. PATENT DOCUMENTS 1,393,163 A * 10/1921 Rasely ..... 434/151
1,964,007 A * 6/1934 Parks ..... 273/157 R (Continued)

FOREIGN PATENT DOCUMENTS

GB 621688 A 4/1949
WO 99/16524 A1 4/1999

OTHER PUBLICATIONS

International Search Report issued on Oct. 21, 2010 in respect of International Application No. PCT/CA2010/000925.

(Continued)

*Primary Examiner* — Steven Wong
(74) *Attorney, Agent, or Firm* — Bereskin & Parr LLP/S.E.N.C.R.L., s.r.l.

(57) ABSTRACT

A puzzle kit for assembly into a three dimensional representation of a geographic region includes first pieces that form a first layer, second pieces that form a second layer on top of the first layer, and structure pieces mounted on the first and/or second layers. The first and second layers can include retaining elements for retaining the structure pieces. The retaining elements can take the form of voids. The first layer can include image elements visible through the voids of the second layer, and the image elements can include indicia to match the voids with the structure pieces. The first pieces can include anchoring pieces that are elevated and interlock with the second layer. The structure pieces can be sequentially assembled on the first and/or second layers according to an index. The assembled puzzle can represent a city, and the structure pieces can represent buildings within the city.

19 Claims, 11 Drawing Sheets

(56) References Cited

U.S. PATENT DOCUMENTS

| | | | | | |
|---|---|---|---|---|---|
| 2,674,813 | A | * | 4/1954 | Hutchinson | 434/152 |
| 3,485,496 | A | * | 12/1969 | Brunton | 273/157 R |
| 3,558,136 | A | | 1/1971 | McFarland | |
| 3,682,479 | A | * | 8/1972 | Miller et al. | 273/157 R |
| 4,148,580 | A | * | 4/1979 | Hill, Sr. | 434/152 |
| 4,257,606 | A | | 3/1981 | Launzel | |
| 4,469,331 | A | * | 9/1984 | Rinker | 273/157 R |
| 4,494,935 | A | * | 1/1985 | Miller | 434/132 |
| 4,824,112 | A | * | 4/1989 | Roy | 273/157 R |
| 4,874,176 | A | * | 10/1989 | Auerbach | 273/157 R |
| 4,937,181 | A | * | 6/1990 | Rogers | 434/150 |
| 5,251,900 | A | * | 10/1993 | Gallant | 273/157 R |
| 5,332,220 | A | * | 7/1994 | Leavy | 273/148 R |
| 5,348,478 | A | | 9/1994 | Bradshaw | |
| 5,362,054 | A | | 11/1994 | Ashemimry | |
| 5,580,252 | A | | 12/1996 | McCrady | |
| 5,860,650 | A | * | 1/1999 | Scobbie et al. | 273/157 R |
| 6,086,067 | A | * | 7/2000 | Benoit et al. | 273/157 R |
| 6,129,605 | A | * | 10/2000 | Cyrus et al. | 446/118 |
| 6,364,116 | B1 | * | 4/2002 | Ng | 206/579 |
| 8,074,988 | B2 | * | 12/2011 | Sakdinan | 273/157 R |
| 2002/0008355 | A1 | | 1/2002 | Wilson | |
| 2008/0303212 | A1 | | 12/2008 | Lai et al. | |
| 2010/0090400 | A1 | * | 4/2010 | Rosen | 273/157 R |
| 2010/0320686 | A1 | | 12/2010 | Sakdinan | |

OTHER PUBLICATIONS

Office Action issued on Apr. 25, 2011 in respect of U.S. Appl. No. 12/488,103.

Extended European Search Report issued May 3, 2013 in respect of European Application No. 10788564.2.

* cited by examiner

PUZZLE WITH THREE DIMENSIONAL REPRESENTATION OF GEOGRAPHIC AREA

CROSS REFERENCE TO RELATED APPLICATIONS

This is a national stage application of International Application No. PCT/CA2010/000925 filed on Jun. 17, 2010, which claims priority to U.S. application Ser. No. 12/488,103 filed Jun. 19, 2009, now U.S. Pat. No. 8,074,988 issued Dec. 13, 2011. The entire contents of each are hereby incorporated herein by reference.

FIELD

This specification relates to three-dimensional puzzles.

BACKGROUND

The following paragraphs are not an admission that anything discussed in them is prior art or part of the knowledge of persons skilled in the art.

U.S. Pat. No. 3,558,136 (McFarland) discloses a double jigsaw puzzle game wherein two opposing players or teams are provided with identically cut and illustrated, but differently colored, pieces of a scene. A playing board is provided which also includes the scene depicted by the assembled playing pieces. Each player starts with one of the opposite edge portions of the scene on the board and attempts to complete a major portion of the scene by placing the pieces properly on the board in advance of his opponent. As a player progresses with the placement of contiguous pieces of the puzzle, he is credited with scores as indicated on certain of the puzzle pieces. Further there is provided a plurality of playing pieces for each player which he may advantageously place on indicated sections of the puzzle scene as such sections are completed by the player. A starting strip is formed along each of two opposite sides of the board, the inner edges of these strips interlocking with puzzle pieces having a complementary configuration.

U.S. Pat. No. 3,682,479 (Miller et al.) discloses a three dimensional puzzle formed of several, similarly or differently colored, stacked layers of interlocked puzzle segments with each layer containing one or more voids through which portions of the layers beneath it and the interior surface of a supporting tray are visible to produce a pleasing visual effect.

U.S. Pat. No. 4,469,331 (Rinker) discloses a three dimensional jigsaw comprised of a plurality of single-layered and multi-layered interlocking puzzle pieces which combine to form, when the puzzle is assembled, a plurality of superimposed, concentric planer layers of differing surface area. When the puzzle is properly assembled, a continuous homogenous pictoral illustration is displayed on the surface of each visable planar layer of the puzzle.

INTRODUCTION

In an aspect of this specification, a puzzle kit for assembly into a three dimensional representation of a geographic region can comprise: a plurality of first pieces configured for assembly to form a generally planar first layer; a plurality of second pieces configured for assembly to form a generally planar second layer on top of the first layer in a parallel relationship thereto; and a plurality of structure pieces, each of the structure pieces configured to be mounted on at least one of the first and second layers, each of the structure pieces representing a three dimensional structure of the geographic region.

The second layer can comprise a plurality of retaining elements, and the structure pieces can be mountable on the second layer by the retaining elements. The retaining elements can comprise voids or depressions, the voids or depressions sized and shaped to retain the structure pieces generally in friction fit engagement. Each of the retaining elements can be sized and shaped in correspondence with a respective one of the structure pieces to allow matching of the retaining elements and the structure pieces. The retaining elements can comprise voids extending between top and bottom surfaces of the second layer so that the structure pieces can engage the first layer.

The first layer can comprise a plurality of image elements arranged in alignment with the voids of the second layer so that the image elements are visible through the voids. The image elements visible through the voids can include indicia that corresponds with a respective one of the structure pieces to allow matching of the voids and the structure pieces.

The plurality of first pieces can comprise anchoring pieces that are elevated relative to a top surface of the first layer when assembled, and the plurality of second pieces can be configured for interlocking assembly with the anchoring pieces to form the second layer. The anchoring pieces can have a height dimension that is similar to a height dimension of the second layer so that top surfaces of the anchoring pieces are generally flush with a top surface of the second layer.

At least one of the first and second layers can include graphic elements representing features of the geographic region. The geographic region can include a city, and the structure pieces can represent buildings within the city. The structure pieces can be sized and shaped relative to one another according to a non-scale relationship.

The structure pieces can be indexed. The structure pieces can be indexed according to year of construction of the respective building. The puzzle kit can further comprise written material including information about the buildings arranged according to the index.

In an aspect of this specification, a puzzle kit for assembly into a three dimensional representation of a geographic region can comprise: a plurality of first pieces configured for assembly to form a generally planar first layer, the first layer including a top surface having plurality of image elements; a plurality of second pieces configured for assembly to form a generally planar second layer on top of the first layer in a parallel relationship thereto, the second layer having top and bottom surfaces and including a plurality of voids extending between the top and bottom surfaces, the voids arranged so that each of the image elements of the first layer are in alignment with and visible through a respective one of the voids; and a plurality of structure pieces, each of the structure pieces representing a three dimensional structure of the geographic region, each of the structure pieces sized and shaped to be retained by a respective one of the voids of the second layer, the image elements of the first layer including indicia for matching each of the voids with a respective one of the structure pieces.

In an aspect of this specification, a method of assembling a puzzle kit into a three dimensional representation of a geographic region can comprise the steps of: providing a plurality of first pieces, and assembling the first pieces to form a generally planar first layer; providing a plurality of second pieces, and assembling the second pieces to form a generally planar second layer on top of the first layer in a parallel relationship thereto, the second layer including a plurality of voids extending between top and bottom surfaces; providing a plurality of structure pieces, each of the structure pieces representing a three dimensional structure of the geographic region, each of the structure pieces sized and shaped to be received and retained in a respective one of the voids of the second layer, the structure pieces organized according to an index; and according to the index, sequentially engaging each of the structure pieces with its respective void of the second layer to mount the structure pieces to the first and second layers. The structure pieces can be organized in the index according to dates of construction.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
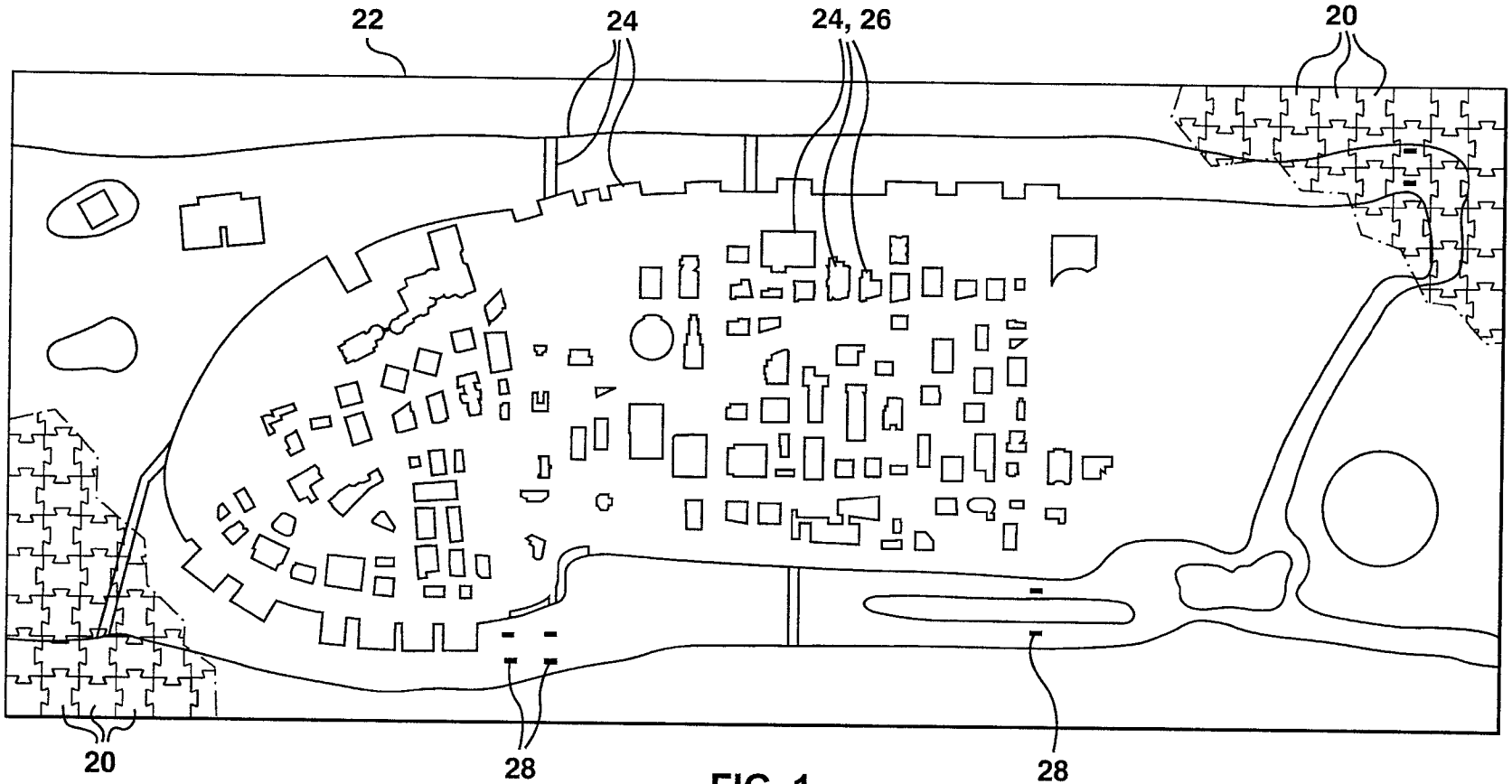
FIG. 1 shows a top view of a first layer of a puzzle.
Figure 2:
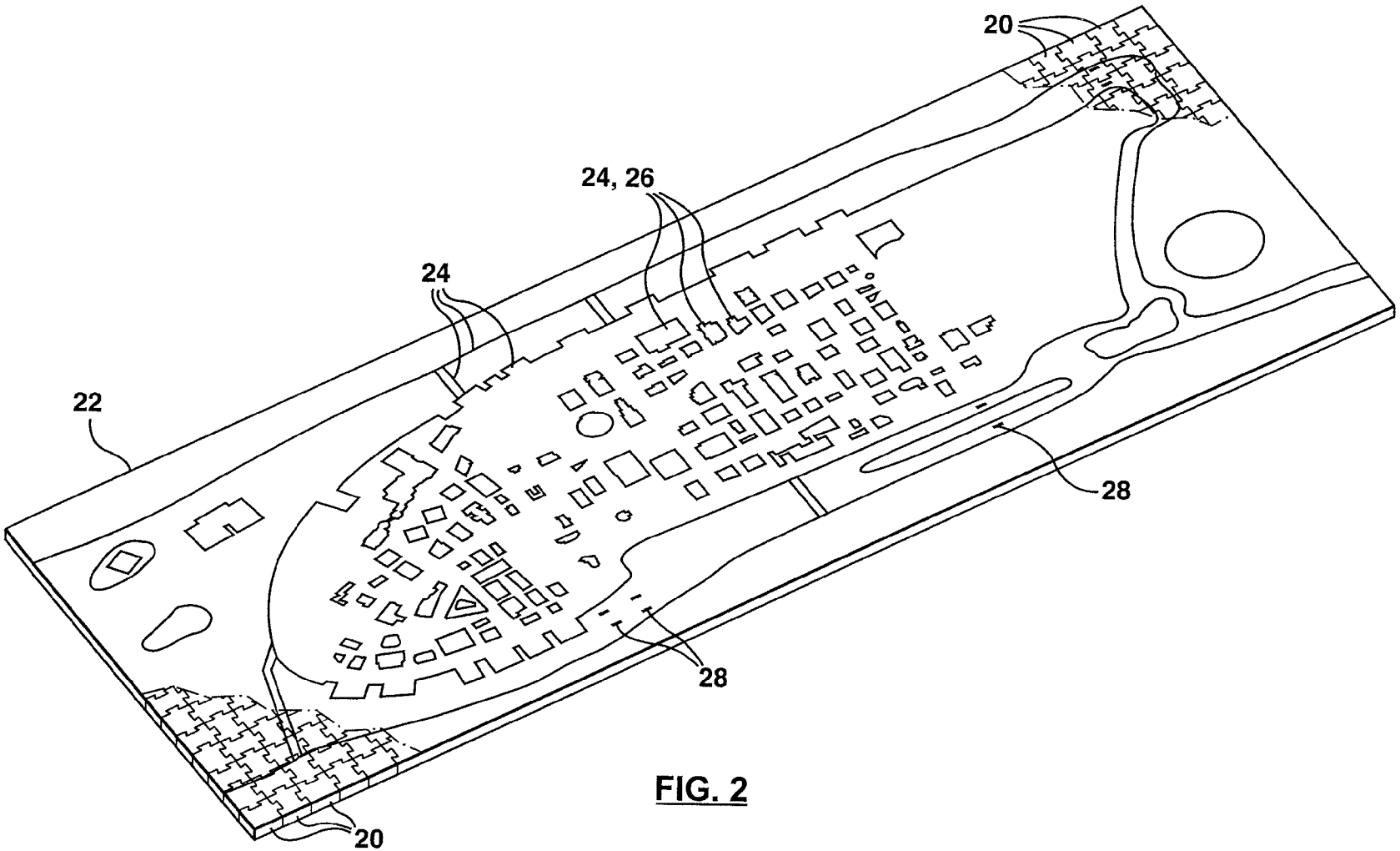
FIG. 2 shows a perspective view of a first layer of a puzzle.

Referring to FIGS. 1 and 2, a plurality of first pieces 20 is shown. The first pieces 20 are puzzle pieces configured for assembly to form a generally planar first layer 22. The first layer 22 is generally planar but need not be perfectly flat, and for example can contain relief features (not shown). The first pieces 20 can be formed of paper or plastic foam.

The first pieces 20 can be of various complementary sizes and shapes and can interlock with one another according to a typical jigsaw pattern to form the first layer 22. For the purposes of illustration and for clarity, only a portion of the first layer 22 is shown formed of the first pieces 20 interlocking in a jigsaw pattern, but the jigsaw pattern extends across the first layer 22 in its entirety. Although the first pieces 20 are shown interlocking according to a jigsaw pattern to form the first layer 22, connecting configurations other than a jigsaw pattern are possible.

A top surface of the first layer 22 can include various graphic elements 24. The graphic elements 24 can represent various features of a particular geographic region from an aerial viewpoint. The graphic elements 24 can complement relief features, if any. The graphic elements 24 can include a plurality of image elements 26 that correspond to structure pieces, as described in further detail below.

The first layer 22 can include a plurality of retaining elements 28 sized and shaped to retain structure pieces (not shown). The retaining elements 28 can take the form of depressions that extend partially from the top surface towards the bottom surface of the first layer 22, or the retaining elements 28 can take the form of voids that extend fully between the top and bottom surfaces of the first layer 22. Various structure pieces can be configured to be mounted in the retaining elements 28 by, for example but not limited to, friction fit engagement.

Figure 3:
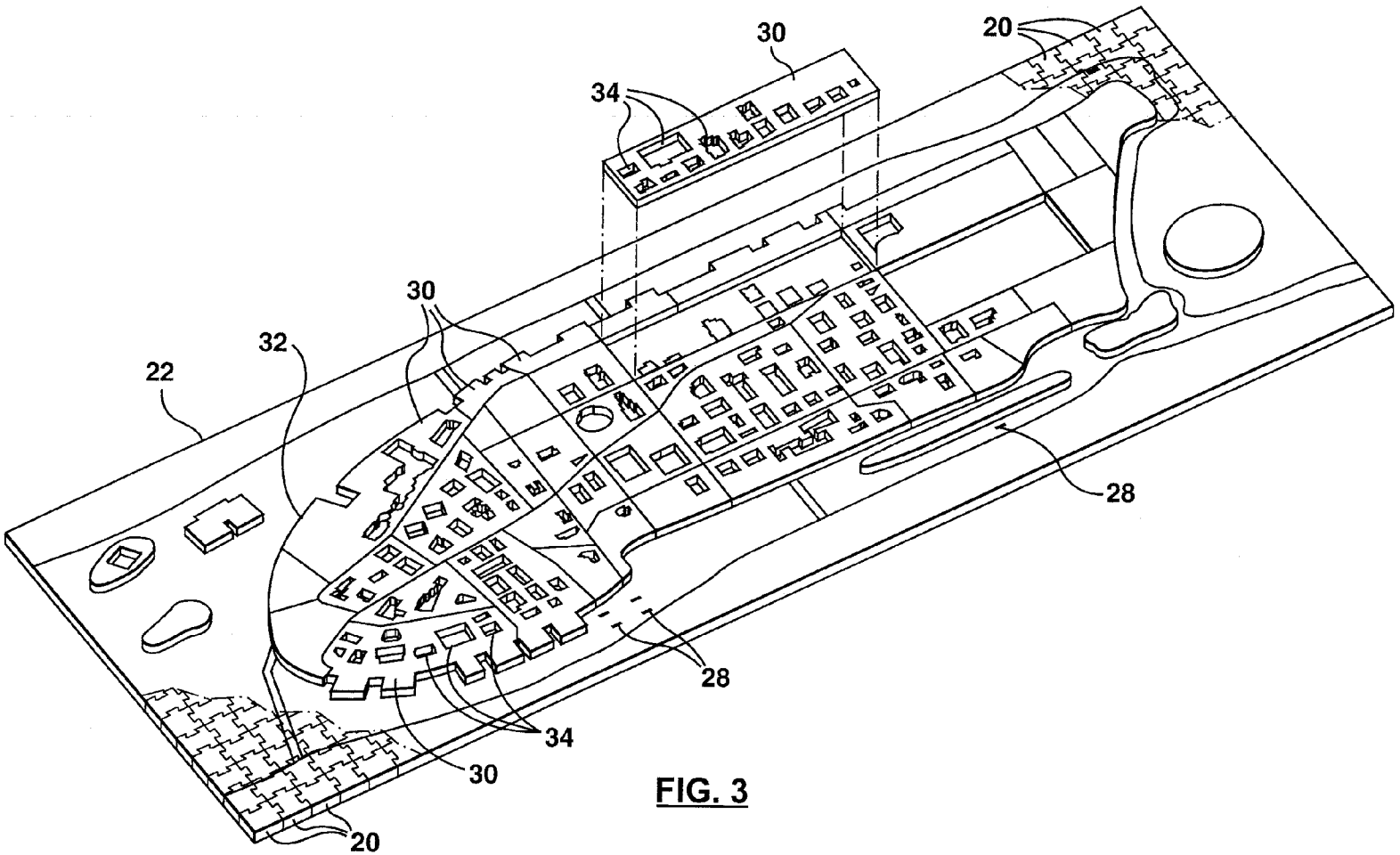
FIG. 3 shows a perspective view of first and second layers of a puzzle.

Referring to FIG. 3, a plurality of second pieces 30 is shown. The second pieces 30 are puzzle pieces configured for assembly to form a generally planar second layer 32 on top of the first layer 22 in a parallel relationship thereto. The second layer 32 is generally planar but need not be perfectly flat, and for example can contain relief features (not shown). The second pieces 30 can be of various complementary sizes and shapes allowing them to interconnect with one another (as illustrated). Alternatively, the second pieces 30 can also interlock with one another according to a jigsaw pattern, similar to that of the first pieces 20. Other connecting configurations are possible for the second pieces 30 to form the second layer 32.

The second pieces 30 can be formed of paper or plastic foam. A top surface of the second layer 32 can include various graphic elements (not shown) that, for example, represent various features of the geographic region from an aerial viewpoint. Optionally, graphic elements provided on the first or second layers 22, 32 can include glow-in-the-dark elements.

The second layer 32 includes a plurality of retaining elements 34 sized and shaped to retain structure pieces (not shown). The retaining elements 34 can take the form of depressions that extend partially between the top surface towards the bottom surface of the second layer 32, or the retaining elements 34 can take the form of voids that extend fully between the top and bottom surfaces of the second layer 32, as described in further detail below.

Figure 4:
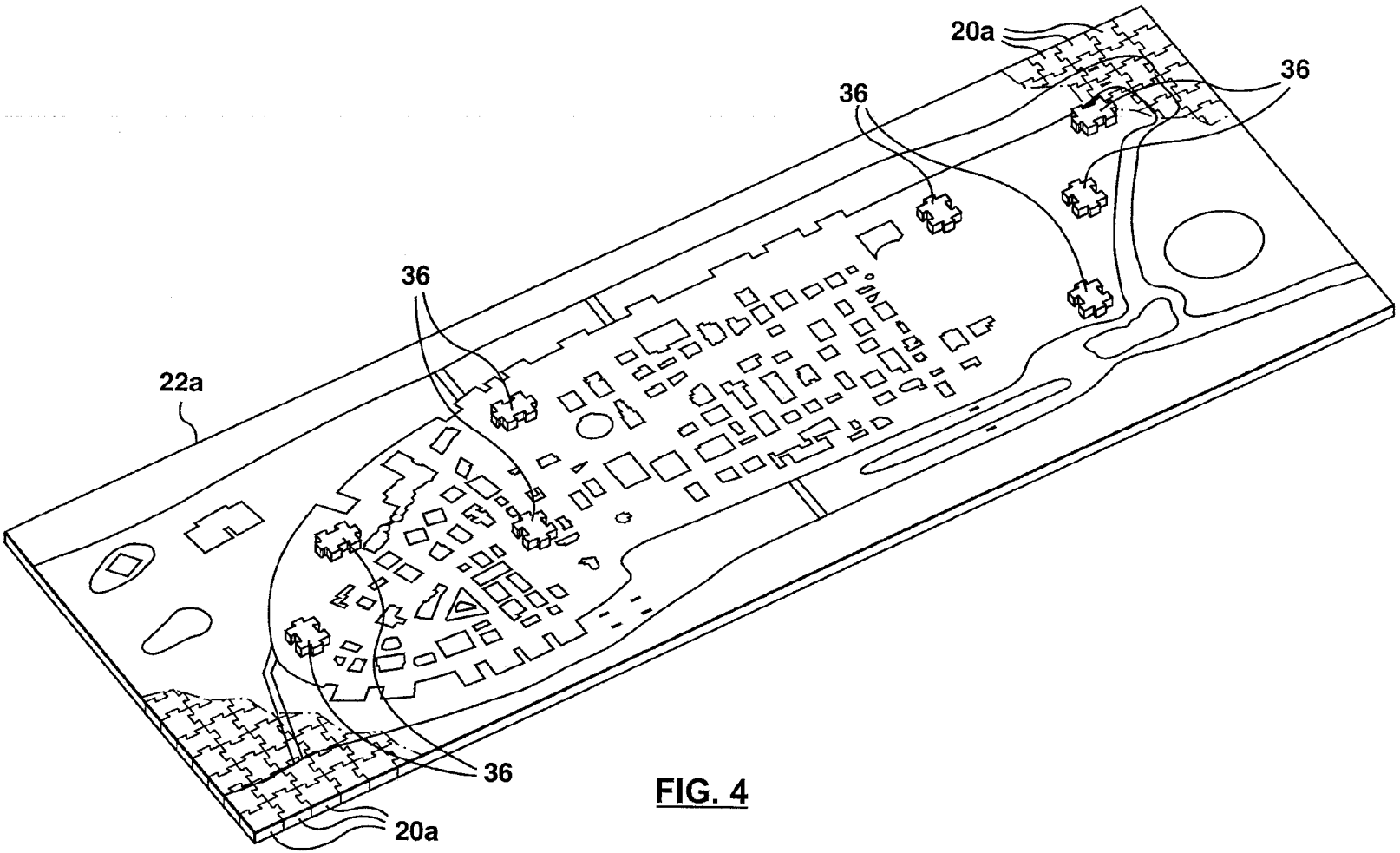
FIG. 4 shows a perspective view of a first layer of another puzzle.
Figure 5:
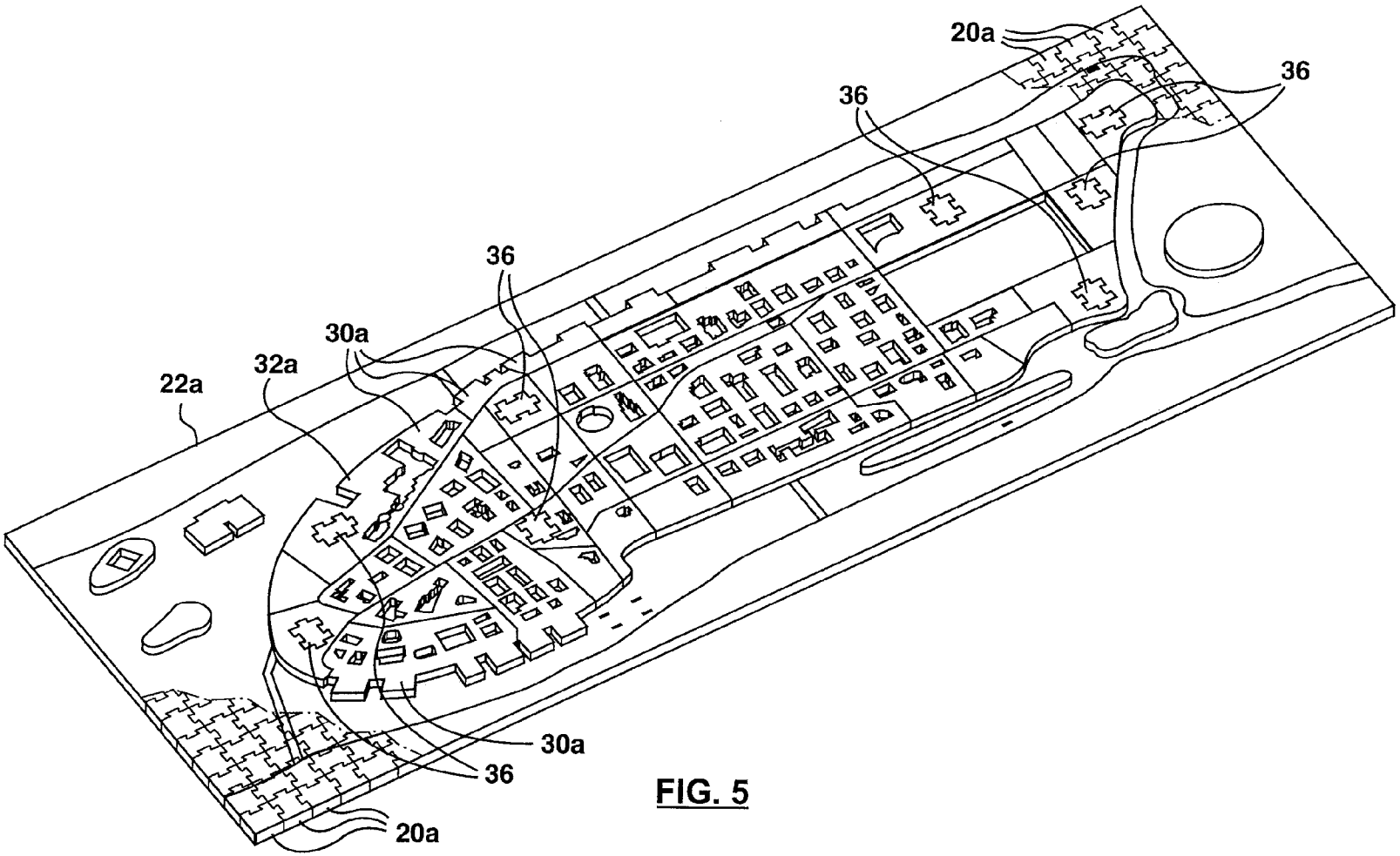
FIG. 5 shows a perspective view of first and second layers of another puzzle.

FIGS. 4 and 5 show modified first and second layers 22*a*, 32*a* in accordance with another example that is similar to the example shown in FIGS. 2 and 3. The first pieces 20*a* are puzzle pieces configured for assembly to form a generally planar first layer 22*a*. The first pieces 20*a* include at least one anchoring piece 36 that is elevated relative to a top surface of the first layer 22*a* when assembled. The second pieces 30*a* are configured for assembly with the anchoring pieces 36 to form the second layer 32*a*. The first and second layers 22*a*, 32*a* can have similar height dimensions, and the anchoring pieces 36 can have a height dimension that is similar to the height dimension of the second layer 32*a* so that top surfaces of the anchoring pieces 36 are generally flush with a top surface of the second layer 32*a*.

During manufacturing, the anchoring pieces 36 can be formed by bonding a first piece with a corresponding second piece to form the anchoring piece 36 having a suitable height dimension. For ease of manufacture, the first piece can be sized generally larger in area than the corresponding second piece, so that perfect alignment of the first and second pieces is not necessary when bonding the pieces together.

Figure 6A:
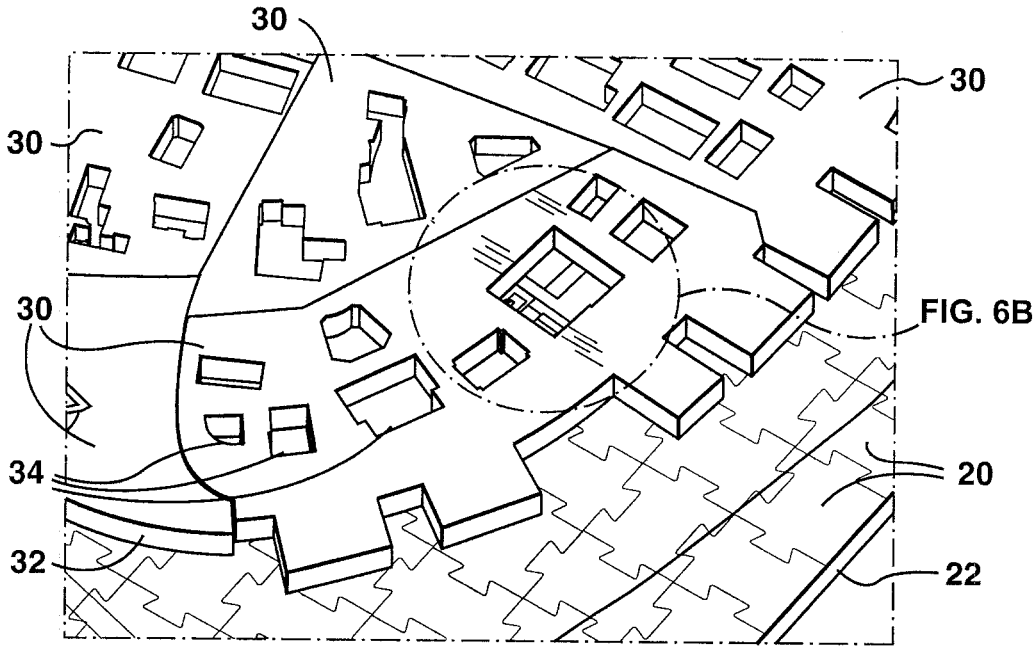
FIG. 6A shows a detailed perspective view of first and second layers of a puzzle.
Figure 6B:
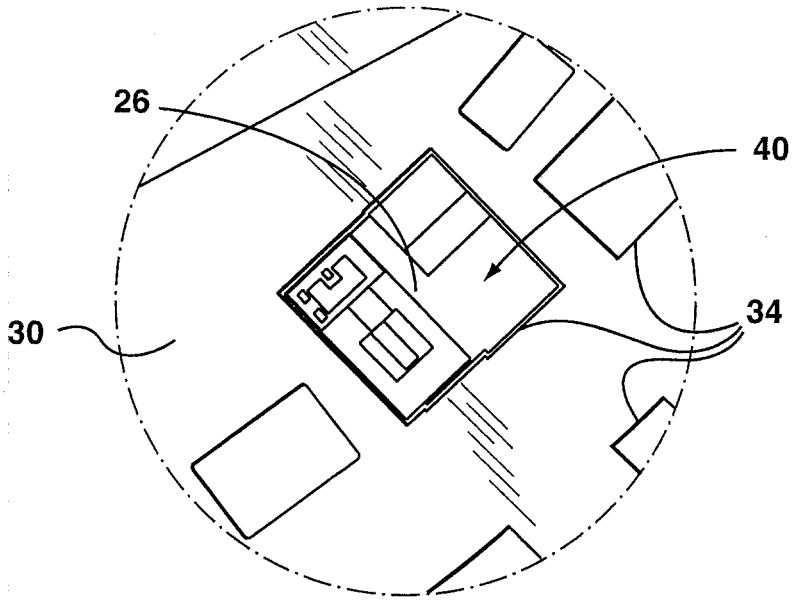
FIG. 6B shows a detailed top view of first and second layers of a puzzle.
Figure 7:
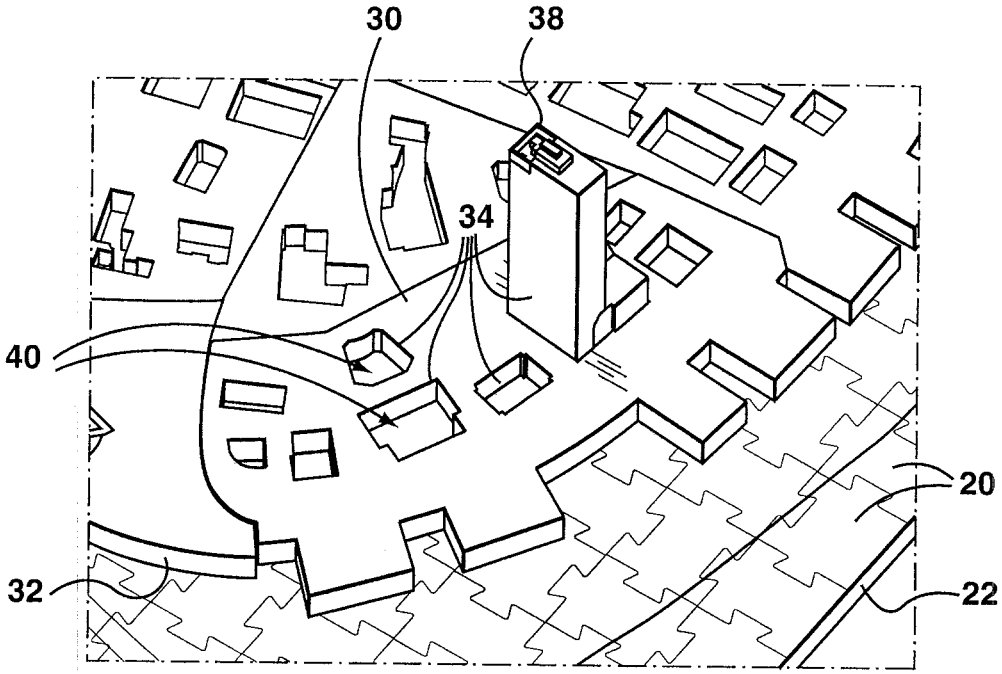
FIG. 7 shows a detailed perspective view of a structure piece mounted on first and second layers of a puzzle.
Figure 8:
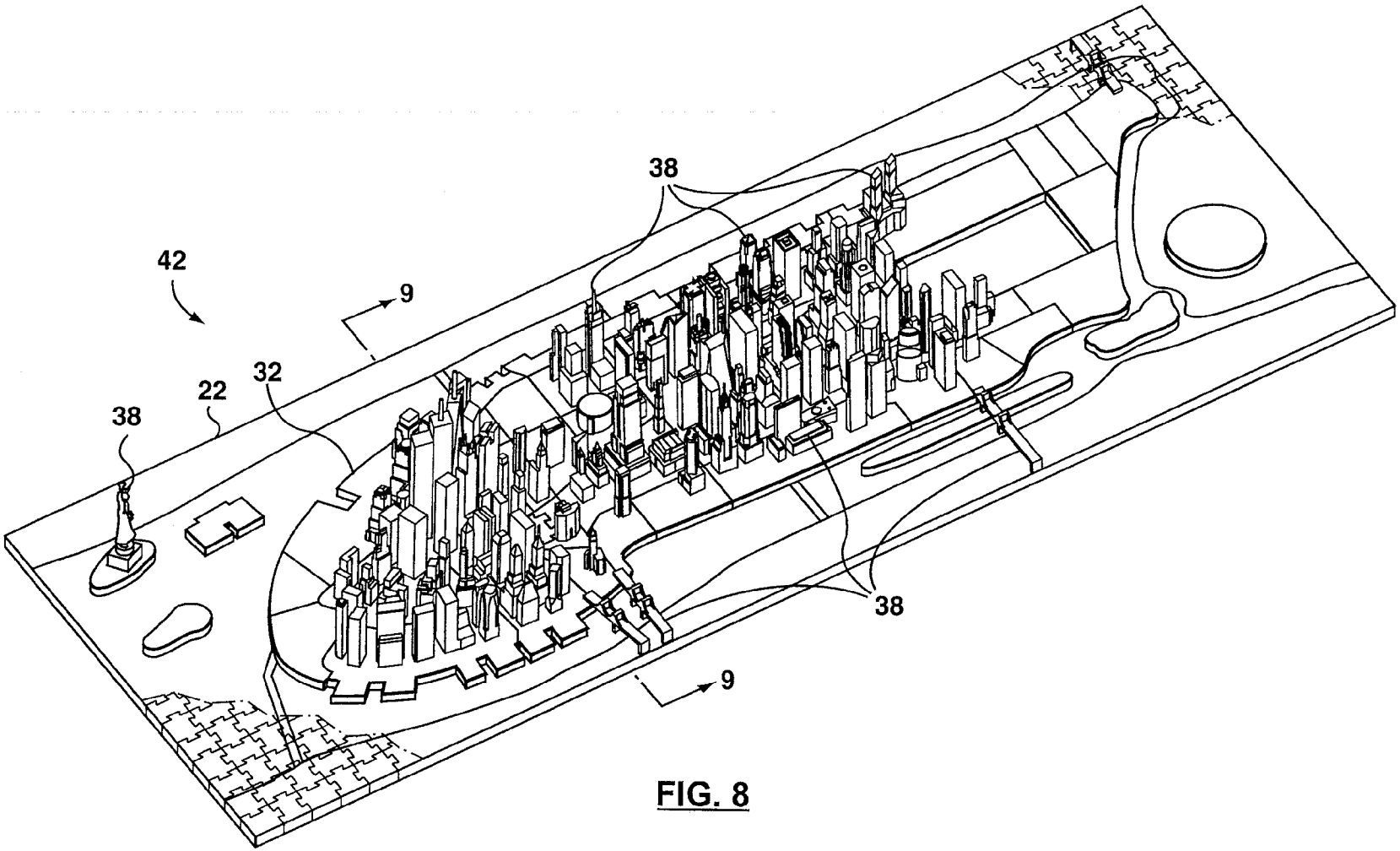
FIG. 8 shows a perspective view of an assembled puzzle.

Referring to FIGS. 6A, 6B and 7, the second pieces 30 forming the second layer 32 can each include one or more of the retaining elements 34. Each of the retaining elements 34 can be sized and shaped to receive a respective structure piece 38 in, for example but not limited to, friction fit engagement. Each of the retaining elements 34 can be sized and shaped in correspondence with respective structure pieces 38 to allow a person to match the retaining elements 34 with the structure pieces 38.

Each of the structure pieces 38 can represent a three dimensional structure or landmark of the geographic region. The structure pieces 38 can be formed of hollow or solid plastic. Optionally, the structure pieces 38 can include glow-in-the-dark elements.

Figure 9:
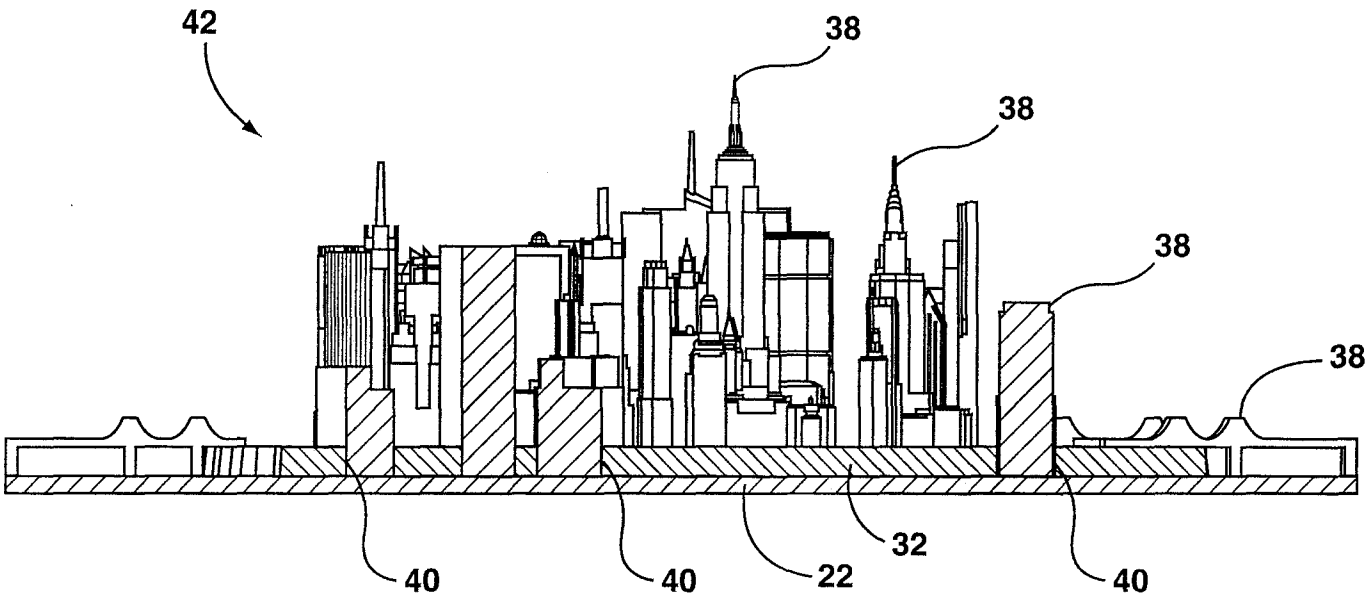
FIG. 9 shows a sectional view of the assembled puzzle shown in FIG. 8.
Figure 10:
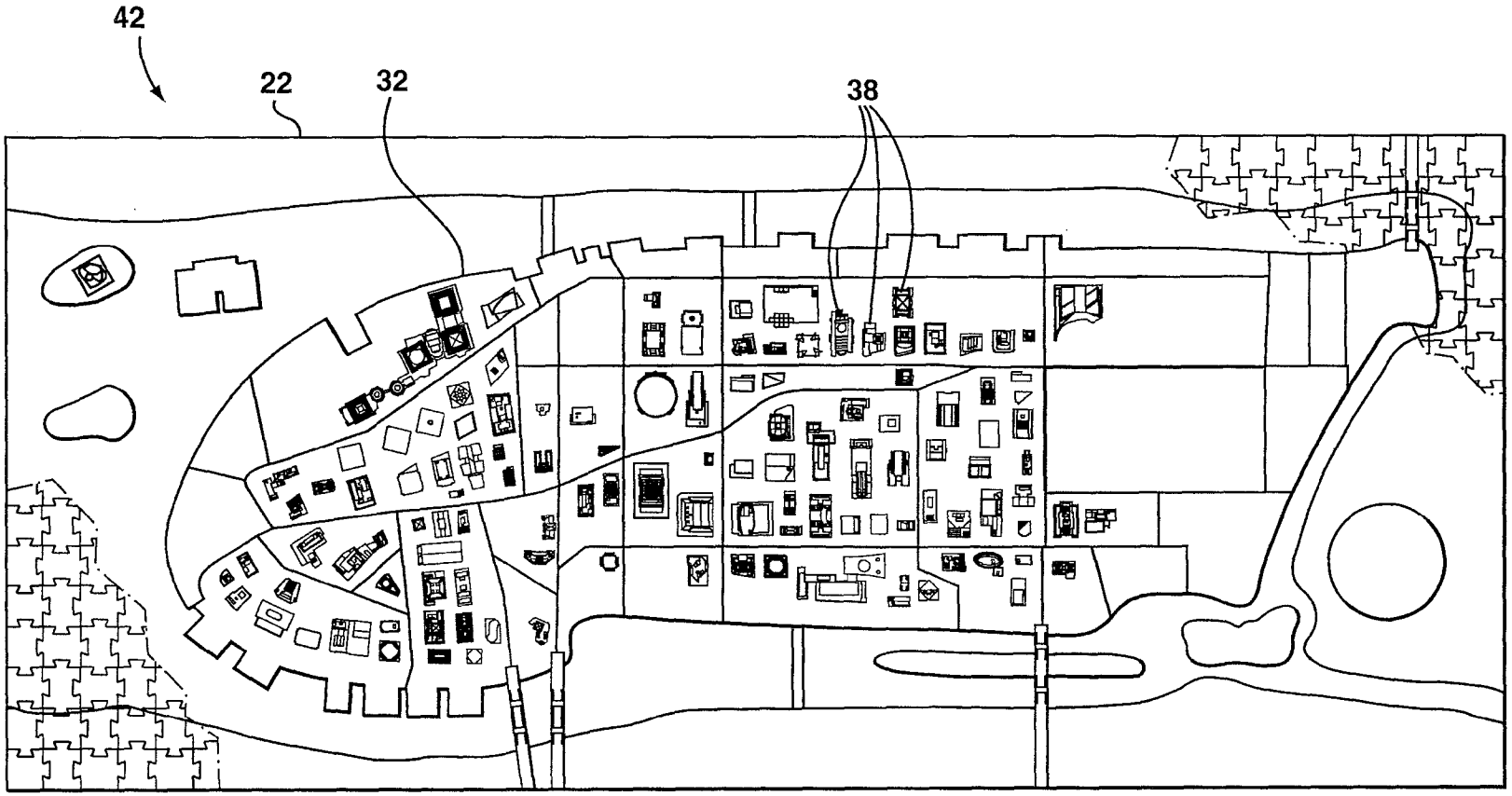
FIG. 10 shows a top view of the assembled puzzle shown in FIG. 8.
Figure 11:
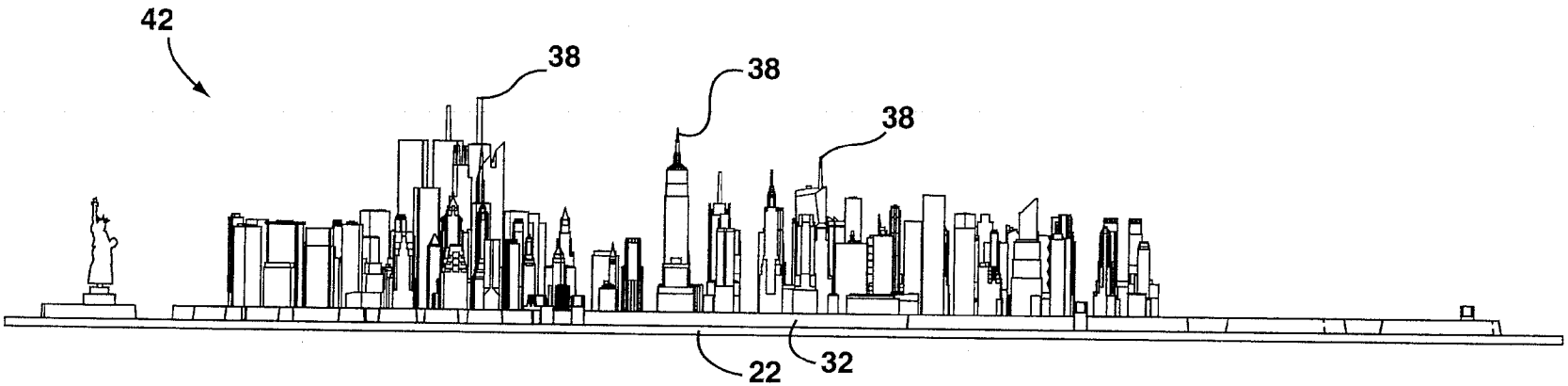
FIG. 11 shows a side view of the assembled puzzle shown in FIG. 8.
Figure 12:
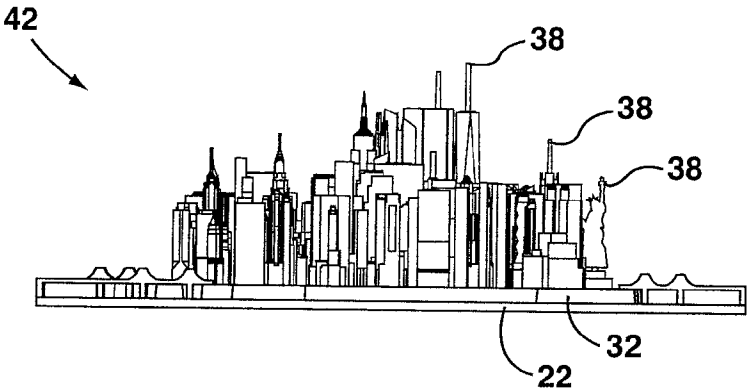
FIG. 12 shows an end view of the assembled puzzle shown in FIG. 8.

As illustrated, the retaining elements 34 can include or take the form of voids 40 that extend between top and bottom surfaces of the second layer 32 (see for example FIG. 9). Each particular structure piece 38 can be received in friction fit with a respective one of the voids 40 of the second layer 32, and thus the structure pieces 38 can engage the first layer 22 when mounted.

As mentioned above, a top surface of the first layer 22 can include a plurality of image elements 26. The image elements 26 can be arranged in alignment with the voids 40 of the second layer 32 so that the image elements 26 are visible through the voids 40. The image elements 26 of the first layer 22 that are visible through the voids 40 can include indicia to allow a person to match the voids 40 with a respective one of the structure pieces 38. For example, the image elements 26 can include a "birds-eye view" aerial representation of the top of a particular one of the structure pieces 38 (see FIG. 6B), which can allow a person to match the particular one of the structure pieces 38 with a respective one of the voids 40. In other examples, the image elements 26 can include text or numbering corresponding with the particular structure piece 38 to allow a person to match the structure piece 38 with a respective one of the voids 40.

Referring to FIGS. 8 to 12, the first layer 22, the second layer 32 and the structure pieces 38 can be provided together as a kit for assembly into a completed puzzle 42 that is a three dimensional representation of a geographic region.

In some examples, the completed puzzle 42 can take the form of a "cityscape", in which the geographic region is a city, and the structure pieces 38 represent buildings within the city. In the particular example illustrated, the geographic region is New York City, and the structure pieces 38 represent notable buildings, bridges and other structures in New York City. However, it should be appreciated that the teachings herein are not limited to cityscapes and that representations of various other geographic regions are contemplated.

As illustrated, the structure pieces 38 can be sized and shaped relative to one another according to a non-scale relationship, which allows for the placement of relatively small but notable structures to be included along with larger structures in the puzzle kit. If the structures arranged according to a non-scale relationship, the completed puzzle 42 results in a "caricature" of the geographic region, rather than a true or scale representation thereof.

The structure pieces 38 can be indexed for assembly. For example, the structure pieces 38 can be indexed according to date of construction of the respective building, size of the respective building, neighborhood of respective building, etc. The puzzle kit can include written material (for example, a poster or a small booklet) including educational information about the buildings arranged according to the index. A person assembling the puzzle kit can, according to the index, sequentially engage each of the structure pieces 38 with its respective retaining element 28, or 34 of the first or second layers 22, 32 to mount the structure pieces 38 to the first and second layers 22, 32.

While the above description provides examples of one or more processes or apparatuses, it will be appreciated that other processes or apparatuses may be within the scope of the accompanying claims.

I claim:

1. A puzzle kit for assembly into a three dimensional representation of a geographic region, comprising:

a plurality of pieces configured for assembly to form at least one layer, the at least one layer comprising a plurality of retaining elements arranged across an upper surface thereof; and a plurality of structure pieces configured to be mounted on the upper surface of the at least one layer by the plurality of retaining elements, each of the structure pieces representing a three dimensional structure of the geographic region, and, for each of the structure pieces, at least a bottom portion has at least one of a size and a shape that is distinct in comparison with the other structure pieces, wherein each of the retaining elements comprises a void or depression, the void or depression sized and shaped in correspondence with the bottom portion of a respective one of the structure pieces to allow matching of the respective one of the structure pieces with the retaining element, and to retain the bottom portion of the respective one of the structure pieces generally in friction fit engagement, wherein the at least one layer comprises graphic elements representing features of the geographic region, and wherein the geographic region comprises a city, and the structure pieces represent buildings within the city.

2. The puzzle kit of claim 1, wherein the at least one layer comprises a generally planar first layer, and a generally planar second layer on top of the first layer in a parallel relationship thereto.

3. The puzzle kit of claim 2, wherein the plurality of pieces comprises a plurality of first pieces configured for assembly to form the first layer.

4. The puzzle kit of claim 3, wherein the plurality of pieces comprises a plurality of second pieces configured for assembly to form the second layer.

5. The puzzle kit of claim 4, wherein the plurality of retaining elements comprises voids extending between top and bottom surfaces of the second layer.

6. The puzzle kit of claim 5, wherein the first layer comprises a plurality of image elements arranged in alignment with the voids of the second layer so that the image elements are visible through the voids.

7. The puzzle kit of claim 6, wherein the plurality of image elements visible through the voids comprises indicia that corresponds with the structure pieces to allow matching of the voids and the structure pieces.

8. The puzzle kit of claim 4, wherein the plurality of first pieces comprises anchoring pieces that are elevated relative to a top surface of the first layer when assembled, and the plurality of second pieces are configured for interlocking assembly with the anchoring pieces to form the second layer.

9. The puzzle kit of claim 8, wherein the anchoring pieces have a height dimension that is similar to a height dimension of the second layer so that top surfaces of the anchoring pieces are generally flush with a top surface of the second layer.

10. The puzzle kit of claim 1, wherein the structure pieces are indexed.

11. The puzzle kit of claim 10, wherein the structure pieces are indexed according to year of construction of the respective building.

12. The puzzle kit of claim 11, further comprising written material comprising information about the buildings arranged according to the index.

13. The puzzle kit of claim 1, wherein the structure pieces are sized and shaped relative to one another according to a non-scale relationship.

14. A puzzle kit for assembly into a three dimensional representation of a geographic region, comprising:

a plurality of pieces configured for assembly to form at least one layer, the at least one layer comprising a plurality of voids arranged across an upper surface thereof; and a plurality of structure pieces configured to be mounted on the upper surface of the at least one layer, each of the structure pieces representing a three dimensional structure of the geographic region, and, for each of the structure pieces, at least a bottom portion has at least one of a size and a shape that is distinct in comparison with the other structure pieces, wherein each of the voids is sized and shaped in correspondence with the bottom portion of a respective one of the structure pieces to allow matching of the respective one of the structure pieces with the void, and to retain the bottom portion of the respective one of the structure pieces generally in friction fit engagement, and wherein the structure pieces are sized and shaped relative to one another according to a non-scale relationship.

15. A puzzle kit for assembly into a three dimensional representation of a geographic region, comprising:

a plurality of pieces configured for assembly to form at least one layer, the at least one layer comprising a plurality of depressions arranged across an upper surface thereof; and a plurality of structure pieces configured to be mounted on the upper surface of the at least one layer, each of the structure pieces representing a three dimensional structure of the geographic region, and, for each of the structure pieces, at least a bottom portion has at least one of a size and a shape that is distinct in comparison with the other structure pieces, wherein each of the depressions is sized and shaped in correspondence with the bottom portion of a respective one of the structure pieces to allow matching of the respective one of the structure pieces with the depression, and to retain the bottom portion of the respective one of the structure pieces generally in friction fit engagement, and wherein the structure pieces are sized and shaped relative to one another according to a non-scale relationship.

16. The puzzle kit of claim 14, wherein the geographic region comprises a city, and the structure pieces represent buildings within the city.

17. The puzzle kit of claim 14, further comprising written material comprising information about the structure pieces arranged according to an index.

18. The puzzle kit of claim 15, wherein the geographic region comprises a city, and the structure pieces represent buildings within the city.

19. The puzzle kit of claim 15, further comprising written material comprising information about the structure pieces arranged according to an index.

* * * * *